US006036843A

United States Patent [19]

Marzari et al.

[11] Patent Number: 6,036,843

[45] Date of Patent: Mar. 14, 2000

[54] METHOD FOR REDUCING HYDROGEN CHLORIDE EMISSIONS FROM AN ASPHALT AIR-BLOWING PROCESS

[75] Inventors: Jorge Alberto Marzari, Bolingbrook; Katherine Elizabeth Poterek, Arlington Heights; David Charles Trumbore, LaGrange; Michael Richard Franzen, Lombard, all of Ill.; Herman P. Benecke, Columbus, Ohio; Timothy Thomas Picman, Bridgeview, Ill.

[73] Assignee: Owens Corning Fiberglas Technology, Inc., Summit, Ill.

[21] Appl. No.: 09/223,050

[22] Filed: Dec. 30, 1998

[51] Int. Cl.[7] ..... C10C 1/00

[52] U.S. Cl. ..... 208/44; 208/6; 208/39; 208/43; 208/22

[58] Field of Search ..... 208/6, 39, 43, 208/44, 22; 106/284.03

[56] References Cited

U.S. PATENT DOCUMENTS

| | | | |
|---|---|---|---|
| 1,997,569 | 4/1935 | Craig et al. . | |
| 2,112,250 | 3/1938 | Penniman . | |
| 2,179,208 | 11/1939 | Burk et al. . | |
| 2,313,596 | 1/1943 | Sorem et al. | 106/14 |
| 2,506,283 | 5/1950 | Smith et al. . | |
| 3,440,073 | 4/1969 | Fowler et al. . | |
| 4,243,519 | 1/1981 | Schorfeide | 208/59 |
| 4,741,868 | 5/1988 | Rooney et al. . | |
| 4,915,714 | 4/1990 | Teague et al. . | |
| 4,950,384 | 8/1990 | Groenveld | 208/59 |
| 4,954,241 | 9/1990 | Kukes et al. | 208/59 |
| 5,045,094 | 9/1991 | Paranjpe . | |
| 5,601,702 | 2/1997 | Yan | 208/390 |
| 5,611,910 | 3/1997 | Marzari et al. . | |
| 5,705,052 | 1/1998 | Gupta | 208/57 |
| 5,720,872 | 2/1998 | Grupta | 208/57 |

OTHER PUBLICATIONS

Article entitled "Pick the Best Acid–Gas Emission Controls for Your Plant", Chemical Engineering Progress, Oct. 1998.

Article entitled "Antibiotics to Batteries", Encyclopedia of Chemical Technology, Fourth Edition, vol. 3, dated 1992.

*Primary Examiner*—Helane Myers

*Attorney, Agent, or Firm*—Inger H. Eckert; James J. Dottavio

[57] ABSTRACT

In a method for reducing hydrogen chloride emissions from an asphalt blowing process, ferric chloride and/or ferrous chloride are added to the asphalt. A chemical modifier is also added to the asphalt. The asphalt is subjected to a blowing process which produces hydrogen chloride emissions. The addition of the chemical modifier reduces the hydrogen chloride emissions by at least 25% compared to the same process without the addition of the chemical modifier. The addition of the ferric chloride and/or ferrous chloride provides beneficial effects such as increased blowing rate and increased final penetration of the asphalt. Preferably, the addition of the chemical modifier does not significantly reduce these beneficial effects.

20 Claims, No Drawings

METHOD FOR REDUCING HYDROGEN CHLORIDE EMISSIONS FROM AN ASPHALT AIR-BLOWING PROCESS

TECHNICAL FIELD AND INDUSTRIAL APPLICABILITY OF THE INVENTION

This invention relates in general to processing asphalt, and particularly to a method for reducing hydrogen chloride emissions from an asphalt air-blowing process. More particularly, this invention relates to a method for reducing hydrogen chloride emissions from air-blowing an asphalt modified with ferric chloride or ferrous chloride, by adding a chemical modifier to the asphalt before the air-blowing process or early in the process. The method has industrial applicability, e.g., in air-blowing asphalt for use as a roofing asphalt.

BACKGROUND OF THE INVENTION

Although most asphalts are used for paving, some asphalts are used for other applications such as roofing. Not all available asphalts are naturally suitable for roofing applications. Asphalts for roofing are air-blown to raise the softening point of the asphalt and to meet other specifications. One way to utilize more asphalt feedstocks for roofing is to add a ferric chloride or ferrous chloride catalyst to the asphalt before the air-blowing process. The ferric chloride or ferrous chloride improves asphalt properties such as penetration at a targeted softening point and accelerates the air-blowing process to reduce processing time.

Unfortunately, hydrogen chloride emissions are generated when an asphalt modified with ferric chloride or ferrous chloride is air-blown. When the asphalt is modified with ferric chloride, the reduction of ferric chloride to ferrous chloride during the air-blowing process generates hydrogen chloride emissions. When ferric chloride is added as an aqueous solution to the asphalt, hydrogen chloride emissions are also generated from free hydrochloric acid present in the aqueous solution. More emphasis is being put on regulating the levels of hydrogen chloride emissions to reduce air pollution, and this trend will increase with time. If the regulated emission levels are not achieved, the asphalt production with ferric chloride or ferrous chloride will be restricted. Current methods for reducing hydrogen chloride emissions from an asphalt air-blowing process do not exist.

The patent literature does not suggest a solution to the problem of hydrogen chloride emissions. U.S. Pat. No. 5,611,910 to Marzari et al. discloses a method for reducing sulfur oxide emissions from an asphalt air-blowing process by adding an emission reducing additive to the asphalt prior to air-blowing or early in the process. The additive comprises: (a) at least one compound selected from metal hydroxides, metal oxides, metal carbonates and metal bicarbonates, where the metal is selected from calcium, sodium, potassium and magnesium; and (b) at least one compound selected from metal hydroxides, metal oxides, metal carbonates and metal bicarbonates, where the metal is selected from zinc, copper and aluminum. A preferred additive is a combination of 0.05%–0.075% sodium hydroxide, 0.02%–0.7% zinc oxide, and 0.01%–0.5% copper oxide, by weight of the asphalt and additive.

The Marzari et al. patent does not disclose the use of ferric chloride or ferrous chloride, or the resulting problem of hydrogen chloride emissions. In particular, there is no discussion of a method for reducing hydrogen chloride emissions. Also, the patent discloses the use of a level of sodium hydroxide that the current work indicates will reduce the beneficial effects of ferric chloride or ferrous chloride in increasing reaction rate and improving product properties.

U.S. Pat. No. 2,506,283 to Smith et al. discloses adding ferric chloride to asphalt as a catalyst during an asphalt air-blowing process, and adding a basic metallic or alkaline earth oxide or hydroxide as a separate operation after the air-blowing to prevent the formation of scum on the surface of the asphalt. There is no suggestion to add a chemical modifier to the asphalt before the air-blowing process, and there is no suggestion to reduce hydrogen chloride emissions from the air-blowing. Accordingly, it would be desirable to provide a method for reducing hydrogen chloride emissions from air-blowing an asphalt modified with ferric chloride or ferrous chloride.

SUMMARY OF THE INVENTION

The present invention provides a method for reducing hydrogen chloride emissions from an asphalt blowing process. Ferric chloride and/or ferrous chloride are added to the asphalt. A chemical modifier according to the invention is also added to the asphalt. The asphalt is subjected to a blowing process which produces hydrogen chloride emissions. The addition of the chemical modifier reduces the hydrogen chloride emissions by at least about 25% by weight compared to the same process without the addition of the chemical modifier. The addition of the ferric chloride and/or ferrous chloride provides beneficial effects such as increased blowing rate and increased final penetration of the asphalt. Preferably, the addition of the chemical modifier does not significantly reduce these beneficial effects.

Various objects and advantages of this invention will become apparent to those skilled in the art from the following detailed description of the preferred embodiments.

DETAILED DESCRIPTION AND PREFERRED EMBODIMENTS OF THE INVENTION

This invention relates to a method for reducing hydrogen chloride emissions from air-blowing an asphalt modified with ferric chloride and/or ferrous chloride, by adding a chemical modifier to the asphalt before the air-blowing process or early in the process.

The asphalt raw material to be air-blown can be either a naturally occurring asphalt or a manufactured asphalt produced by refining petroleum. It can include straight-run fractional-derived asphalts, cracked asphalts, asphalts derived from processing such as asphalt oxidizing, propane deasphalting, steam distilling, chemically modifying, and the like. Blends of different kinds of asphalt can also be air-blown.

The asphalt raw material is loaded into an apparatus suitable for air-blowing the asphalt, such as a converter. The asphalt is usually loaded at a temperature ranging from about 175° C. to about 230° C. The air-blowing process involves passing air or another oxygen-containing gas through the asphalt in the converter. A mixture of an oxygen-containing gas with an inert gas such as nitrogen or helium can also be used.

The reaction produced by the air-blowing is exothermic and raises the temperature of the asphalt. The temperature of the asphalt during the air-blowing process usually ranges from about 200° C. to about 270° C. The maximum temperature can be controlled by a water-cooled jacket or other means.

The air-blowing process increases the usefulness of the asphalt by raising the softening point from a typical starting point below about 40° C. to a final softening point of at least about 80° C. The processing time can take from about 1 hour to about 18 hours to reach the desired softening point. The processing time is dependent on the process temperature, the air flow rate, the characteristics of the asphalt, and the specifications of the desired product.

In accordance with the invention, ferric chloride and/or ferrous chloride catalyst is added by blending it into the asphalt prior to the air-blowing process, or by adding it to the asphalt in the converter early in the process, preferably within about the first hour. The addition of ferric chloride and/or ferrous chloride increases the rate of the air-blowing process compared to the same process without the addition of ferric chloride and/or ferrous chloride. The ferric chloride usually increases the rate by at least about 20%, typically by at least about 30%, and more typically by at least about 40% to 50%. The ferrous chloride usually increases the rate by at least about 35%, typically by at least about 45%, and more typically by at least about 50% to 60%.

The addition of ferric chloride and/or ferrous chloride also usually has other beneficial effects, such as increased final penetration of the air-blown asphalt at a target softening point. Both ferric chloride and ferrous chloride usually increase the final penetration of the asphalt by at least about 15%, and typically by at least about 20% to 30%.

The air flow blown through the converter usually ranges from about 220 to about 650 liters (STP) per hour/liter of processed asphalt. The air is bubbled through the hot asphalt, and it produces a fume stream after it passes through the asphalt. The passing air strips some materials from the asphalt, including hydrogen chloride generated from the addition of the ferric chloride and/or ferrous chloride. The fume stream exits the converter and passes through a fume line to a liquid-sealed knockout tank. The liquid in the knockout tank is a mixture of oil and water that condenses from the process. The temperature of the oil/water mixture in the knockout tank typically ranges from about 65° C. to about 121° C. The fume stream is bubbled through the oil/water mixture, and the knockout tank condenses some material from the fume stream; however, a significant amount of material still passes through. Prior to release into the atmosphere, the fume stream is subjected to an incineration process to control the emission of volatile organic compounds. Unfortunately, neither the knockout tank nor the incineration process adequately controls the emission of hydrogen chloride.

In accordance with the present invention, a chemical modifier is added to the asphalt to reduce the hydrogen chloride emissions. As described below, the chemical modifier is a chemical or a combination of chemicals that is effective to reduce the hydrogen chloride emissions. The chemical modifier can be added by blending it into the asphalt prior to the air-blowing process, or by adding it to the asphalt in the converter early in the process, preferably within about the first hour. The chemical modifier can be added before or after the ferric chloride and/or ferrous chloride. The addition of the chemical modifier reduces the hydrogen chloride emissions from the air-blowing process by at least about 25% (by weight percent), preferably by at least about 45%, and more preferably by at least about 65%, compared to the same process without the addition of the chemical modifier. The hydrogen chloride emissions are measured at the outlet of the incinerator stack.

It has been discovered that certain types of chemicals and combinations of chemicals are suitable for use as the chemical modifier, while other chemicals and combinations of chemicals are not suitable. Some chemicals that might have been expected to reduce hydrogen chloride emissions were found to either have no substantial effect on hydrogen chloride emissions or to actually increase the emissions. The materials and process conditions of the air-blowing process present a unique environment, and the chemical modifier must be particularly suitable for use in that environment.

Preferably, the chemical modifier is selected from sodium hydroxide, zinc oxide, ferric stearate, ferric citrate, iron oxide, high molecular weight amines, polyamines, aluminum, a combination of sodium hydroxide and zinc oxide, a combination of sodium hydroxide and ferrous oxide, a combination of aluminum and ferrous oxide, or a combination of aluminum and zinc oxide. More preferably, the chemical modifier is a combination of sodium hydroxide and zinc oxide. The combinations of chemicals have a synergistic effect in reducing hydrogen chloride emissions.

Some proposed reactions with hydrogen chloride in the converter are:

Sodium hydroxide+HCl→sodium chloride+water

Zinc oxide+HCl→zinc chloride+water

Ferric stearate+HCl→ferric chloride+stearic acid

Ferric citrate+HCl→ferric chloride+citric acid

Aluminum+HCl→aluminum chloride+hydrogen

Ferrous oxide+HCl→ferric chloride+water

Jeffamine T-403*+HCl→chloro Jeffamine hydride

*Jeffamine T-403 is trimethylolpropane tris([poly(propylene glycol), amine terminated]), available from Huntsman, Corp., Austin, Tex.

These reactions make the chemical modifiers highly suitable to abstract hydrogen chloride during the air-blowing process.

As discussed above, the addition of the ferric chloride and/or ferrous chloride usually provides beneficial effects such as increased rate of air-blowing and increased final penetration of the asphalt at a targeted softening point. Preferably, the addition of the chemical modifier does not excessively reduce these beneficial effects. Typically, the addition of the chemical modifier does not reduce these beneficial effects by greater than about 50%, preferably by not greater than about 35%, and more preferably by not greater than about 20%. Most preferably, the addition of the chemical modifier does not significantly reduce the beneficial effects of the ferric chloride and/or ferrous chloride.

Accordingly, it has been discovered that some of the chemical modifiers should be limited in the amount added to avoid reducing the beneficial effects of the ferric chloride and/or ferrous chloride. When sodium hydroxide is used as the chemical modifier alone or in combination with other chemical(s), preferably the sodium hydroxide is added at a level of not greater than about 0.012% by weight of the asphalt, per every 0.1% by weight of active ferric chloride or ferrous chloride added to the asphalt. For example, if the level of ferric chloride added is 0.3% by weight of the asphalt, preferably the level of sodium hydroxide added is not greater than about 0.036% by weight of the asphalt. The sodium hydroxide is usually added at a level of at least about 0.001% by weight of the asphalt, typically at least about 0.004%, per every 0.1% by weight of active ferric chloride or ferrous chloride added. When zinc oxide is used as the chemical modifier alone or in combination with other chemical(s), preferably the zinc oxide is added at a level of not greater than about 0.15% by weight of the asphalt, per every 0.1% by weight of active ferric chloride or ferrous chloride added. The zinc oxide is usually added at a level of at least about 0.02% by weight of the asphalt, typically at least about 0.05%, per every 0.1% by weight of active ferric chloride or ferrous chloride added. The term "active"ferric chloride and/or ferrous chloride means the actual weight of ferric chloride and/or ferrous chloride itself, excluding the weight of solvation and solution water.

In another embodiment of the invention, the hydrogen chloride emissions are further reduced by the addition of a filter between the knockout tank and the incinerator. The filter removes hydrogen chloride by condensation and coalescing of the cooled fume stream. The fume stream can be cooled either by natural heat exchange from the fume line to the atmosphere, or by any specific cooling operation. The filter can be any type of filter capable of removing condensable oil or water from the fume stream. If used alone, the filter preferably reduces the hydrogen chloride emissions by at least about 25%, and more preferably by at least about 45%, compared to the same process without the filter. If used in combination with the chemical modifier, the filter preferably reduces the hydrogen chloride emissions by at least about 10% in addition to the reduction provided by the chemical modifier, and more preferably by at least about 20%.

Preferably, the filter is a fiber bed filter. Such filters are described in Kirk-Othmer, Encyclopedia of Chemical Technology, Vol. 1, 4th Ed., pages 799–800 (1991). The fiber bed filter includes a fiber bed element for condensing the fume stream. The fiber bed element is made from fibers that are packed either randomly or in alignment. The use of randomly oriented fiber beds is preferred in the present invention. The randomly oriented fiber beds include those made with mineral fibers such as glass fibers, polymer fibers such as polyester fibers or polypropylene fibers, and fluorocarbon fibers An example of suitable fibers would be finely spun glass fibers having an average diameter of about 1–2 microns. Other fibers will be acceptable depending on their compatibility with the chemical modifier and with asphalt.

In another preferred embodiment of the invention, the hydrogen chloride emissions are further reduced by the injection of water spray or steam into the fume stream immediately downstream from the converter. It has been found that both water spray and steam are effective in removing hydrogen chloride from the fume stream because the hydrogen chloride is highly hygroscopic. Preferably, the water spray or steam is injected into the fume line within about 0.3 meter of exiting the converter. Preferably, the water spray or steam is injected into the fume stream at a rate within the range of from about 0.05 to about 6 liters of condensed water per minute per cubic meter of air flow at STP. If used alone, the water spray or steam preferably reduces the hydrogen chloride emissions by at least about 25%, and more preferably by at least about 45%, compared to the same process without the water spray or steam. If used in combination with the chemical modifier, the water spray or steam preferably reduces the hydrogen chloride emissions by at least about 10% in addition to the reduction provided by the chemical modifier, and more preferably by at least about 20%. If the water spray or steam is used in combination with the filter, the hydrogen chloride emissions are preferably reduced by at least about 65% compared to the same process without the filter and water spray or steam.

EXAMPLE 1

Chemical Modification in Small Converter

The HCl emissions monitoring started out in a 3.785-liter converter. Three different asphalt sources were tested. Before a chemical was added to the converter, the air was turned on at a low setting of 0.28 cubic meter per hour at STP. Then, depending on how many chemicals were added, different amounts of asphalt were first introduced to the converter. If one chemical was to be used (just ferric chloride as a control), one-half the asphalt was loaded; if two chemicals were employed, one-third the asphalt was introduced; and if three chemicals were utilized, one-fourth the asphalt was added to the converter. The ferric chloride was always the first chemical to be added, with a corresponding amount of asphalt on top. The ferric chloride (solid) was added at an active level of 0.3% by weight of the asphalt. This was continued until all the asphalt and chemicals were in the converter. The converter was then put together, the temperature increased to 254° C. and the air increased to 0.85 cubic meter per hour. At this point the test was officially started.

In order to measure the amount of hydrogen chloride emissions from the converter, the following steps were taken. Once the equipment was set up, the exhaust was connected to a series of two 0.2 N sodium hydroxide solution baths. The gases were channeled in such a way that they bubbled through the baths. Most acid gases (HCl, $H_2S$, carboxylic acids) were captured by this solution. A sample was sent to an external lab to measure the chloride ion concentration by an ion chromatography technique.

Results and Conclusions

Each of the three asphalts was run with ferric chloride to determine the amount of emissions generated. Table 1 shows the results of those tests. It can be observed that only about 12–24% of the stoichiometrically expected HCl emissions (due to reduction from ferric chloride to ferrous chloride) evolves from the converter.

TABLE 1

Different HCl Emissions with Different Asphalts

| Asphalt | % Emissions |
|---|---|
| #1 | 12 |
| #2 | 24 |
| #3 | 23 |

A wide variety of chemical additives were introduced in the asphalt in an attempt to reduce HCl emissions. The chemicals added were: aluminum, calcium carbonate, ferric citrate, ferric phosphate, ferric stearate, ferrous oxide, Jeffamine T-403, polyvinyl alcohol (PVA), polyethylene co-glycidyl methacrylate (PEGMA), sodium hydroxide, zinc oxide, zinc, and ethylene vinyl acetate copolymer (Elvaloy, manufactured by DuPont, Wilmington, Del.).

The asphalt blows were completed with each of the above chemicals and 0.3% active ferric chloride in solid form. The results were grouped into three different categories: chemicals that reduced HCl emissions, chemicals that had no effect on HCl emissions, and chemicals that increased HCl emissions. The results are shown in Tables 2–4:

TABLE 2

Chemicals Reducing HCl Emissions

| Single Modifier | Conc. % | % Reduction | Asphalt |
|---|---|---|---|
| Ferric Stearate | 1.14 | 97 | #1 |
| Zinc Oxide | 0.15 | 81 | #1 |
| Ferrous Oxide | 0.20 | 65 | #1 |
| Ferric Citrate | 0.31 | 61 | #1 |
| Jeffamine T-304 | 0.19 | 61 | #1 |
| Ferric Citrate | 0.62 | 59 | #2 |
| Ferrous Oxide | 0.20 | 47 | #2 |
| Ferric Citrate | 0.31 | 45 | #2 |
| Aluminum | 0.07 | 35 | #1 |
| Aluminum | 0.14 | 34 | #2 |
| Sodium Hydroxide | 0.03 | 27 | #3 |

TABLE 3

Chemicals Having No Effect on HCl Emissions

| Single Modifier | Conc. % | % Reduction | Asphalt |
|---|---|---|---|
| Calcium Carbonate | 0.19 | 6 | #2 |
| PVA | 0.26 | 7 | #2 |
| Zinc | 0.12 | −14 | #1 |

TABLE 4

Chemicals Increasing HCl Emissions

| Single Modifier | Conc. % | % Reduction | Asphalt |
|---|---|---|---|
| Ferric Phosphate | 0.54 | −161 | #1 |
| Elvaloy | 0.26 | −144 | #2 |
| PEGMA | 0.13 | −139 | #2 |
| Ferric Phosphate | 0.24 | −118 | #1 |

Further tests were done with zinc oxide to determine the scavenger performance against the concentration added. As shown in Table 5, the zinc oxide provided a good reduction in HCl emissions when added at a level of 0.15%, and it provided a very good reduction in HCl emissions when added at a level of 0.30% or 0.45%.

TABLE 5

Zinc Oxide Varied Concentrations
HCl % Emissions Reduction

| ZnO % | Asphalt #1 | Asphalt #2 |
|---|---|---|
| 0.00 | 0 | 0 |
| 0.15 | 31 | NA |
| 0.30 | 61 | 54 |
| 0.45 | 56 | 71 |

A few combinations of chemicals were tried as the chemical modifier. The results were grouped into two different categories: combinations of chemicals that reduced HCl emissions, and combinations of chemicals that had no effect on HCl emissions. The results are shown in Tables 6 and 7:

TABLE 6

Combinations of Chemicals Reducing HCl Emissions

| Two Modifiers | Conc. % | % Reduction | Asphalt |
|---|---|---|---|
| NaOH + ZnO | 0.03 + 0.15 | 71 | #2 |
| Al + ZnO | 0.06 + 0.15 | 64 | #2 |
| Al + FeO | 0.07 + 0.17 | 42 | #2 |
| NaOH + FeO | 0.03 + 0.17 | 36 | #2 |

TABLE 7

Combinations of Chemicals Having No Effect on HCl Emissions

| Two Modifiers | Conc. % | % Reduction | Asphalt |
|---|---|---|---|
| Elvaloy + CaCO3 | 0.13 + 0.19 | 11 | #2 |

EXAMPLE 2

3,785-Liter Converter Using Solid Ferric Chloride and Chemical Modifiers

The testing was done with asphalt #2 air-blown in a 3,785-liter converter. Solid ferric chloride was added to the asphalt as follows: Starting with 2,724 kilograms of asphalt in the converter, 681 kilograms was moved to the mix tank. The ferric chloride was then added in small amounts to the mix tank through a funnel in the lid of the tank until an active level of 0.3% active ferric chloride by weight of the asphalt was added. When the ferric chloride addition was completed, the asphalt was moved from the mix tank back to the converter.

The chemical modifier was a combination of zinc oxide and sodium hydroxide. After the 681 kilograms of ferric chloride-modified asphalt had been brought back to the converter, another 681 kilograms of unmodified asphalt was pumped to the mix tank. The zinc oxide and sodium hydroxide were added to the mix tank through a funnel in the lid of the tank. Then the asphalt was moved from the mix tank back to the converter, and the modified asphalt was air-blown.

Environmental Equipment Setup

A probe on the incinerator stack pulled samples of the evolving emission gasses at a rate of 6–8 liters per minute. The gas was brought through a heated sample line at 179° C. to a Mini-GASS™ gas analysis sampling system (Perma Pure Inc., Toms River, N.J.). The sampling system removed the water from the gas and sent it to the following analyzers: for hydrogen chloride emissions, a TECO Model 15 analyzer (Thompson Equipment Co., New Orleans, La.); and for sulfur dioxide emissions, a Bovar Model 721 ATM analyzer (Bovar Equipment Co., Hattershein, West Germany). The emissions were measured continuously using these monitors. The analog signal from each monitor was collected by a Campbell CR10 datalogger (Campbell Scientific, Inc., Logan, Utah) and transformed to digital values. After the run, the emissions data were then downloaded to a laptop computer using datalogger support software. The emissions were collected every 30 seconds. The equipment was calibrated before every run using both a zero gas and a calibration gas.

Results and Discussion

Table 8 shows a summary of emissions, processing time and penetration data. The unmodified 0.3% ferric chloride formulation (30+0+0) was repeated four times, with the results being averaged. All other data are single pieces of information or data points. The emissions are in units of kilograms per metric ton (1000 kilograms). "%Ben." means the percentage of the benefit maintained from the addition of the ferric chloride.

TABLE 8

Results from 3,785-Liter Emissions Trial Using Solid Ferric Chloride

| $FeCl_3$ + NaOH + | HCl Emmisions | | SOx Emissions | | Blow Time | | Penetration 25° C. | |
|---|---|---|---|---|---|---|---|---|
| ZnO ($10^{-2}$%) | kg/ton | % Red. | kg/ton | % Red. | hrs. | % Ben. | mm/10 | % Ben. |
| 15 + 2.4 + 30 | 0.035 | 68 | 0.105 | 71 | 5.30 | 28 | 17.2 | 46 |
| 30 + 2.4 + 15 | 0.038 | 65 | 0.093 | 75 | 2.38 | 95 | 19.9 | 88 |
| 30 + 0 + 30 | 0.054 | 49 | 0.086 | 77 | 3.39 | 72 | 19.1 | 76 |
| 15 + 0 + 15 | 0.059 | 45 | 0.126 | 66 | 3.24 | 75 | 17.9 | 57 |

TABLE 8-continued

Results from 3,785-Liter Emissions Trial Using Solid Ferric Chloride

| $FeCl_3$ + NaOH + | HCl Emmisions | | SOx Emissions | | Blow Time | | Penetration 25° C. | |
|---|---|---|---|---|---|---|---|---|
| ZnO ($10^{-2}$%) | kg/ton | % Red. | kg/ton | % Red. | hrs. | % Ben. | mm/10 | % Ben. |
| 15 + 0 + 0 | 0.059 | 45 | 0.156 | 58 | 2.86 | 84 | 18.7 | 70 |
| 15 + 1.2 + 0 | 0.063 | 41 | 0.154 | 58 | 3.93 | 59 | 16.9 | 41 |
| 30 + 2.4 + 0 | 0.064 | 41 | 0.138 | 63 | 2.14 | 101 | 21.2 | 110 |
| 30 + 2.4 + 30 | 0.073 | 32 | 0.098 | 73 | 4.05 | 57 | 18.9 | 73 |
| | | | Reference | | | | | |
| 0 + 0 + 0 | 0.014 | 88 | 0.368 | 0 | 6.51 | 0 | 14.4 | 0 |
| 30 + 0 + 0 | 0.107 | 0 | 0.159 | 57 | 2.17 | 100 | 20.6 | 100 |

The 0.3% ferric chloride+0.024% sodium hydroxide+0.15% zinc oxide formulation (30+2.4+15) is the optimum formulation in this example, because it not only reduces HCl emissions by 65%, but also it lowers sulfur oxide emissions by 75%, maintains 95% of the increased air-blowing rate benefit from the addition of the ferric chloride, and maintains 88% of the increased final penetration benefit from the addition of the ferric chloride.

EXAMPLE 3

3.785-Liter Converter Using Liquid Ferrous Chloride and Chemical Modifiers

Chemical Addition

The testing was done with asphalt #2 air-blown in the 3,785-liter converter. Liquid ferrous chloride was added to the asphalt as follows: Starting with 2,724 kilograms of asphalt in the converter, 2,270 kilograms was moved to the surge tank, leaving 454 kilograms in the converter. This allowed the asphalt level in the converter to be below the level of the port where the liquid ferrous chloride was added. The blower was turned on and down to a differential pressure reading of 1.8. The liquid ferrous chloride was then added slowly to the asphalt in the converter, using a hand rotary pump.

The chemical modifier was a combination of zinc oxide and sodium hydroxide. The zinc oxide and sodium hydroxide were added to the asphalt in the surge tank. The asphalt in the surge tank was then brought back to the converter and the run started.

Results and Discussion

Table 9 shows a summary of emissions, processing time and penetration data. The unmodified 0.3% ferrous chloride solution was repeated three times, and the results averaged. All other data are single pieces of information. It can be observed that none of the formulations reduces emissions to the extent attainable with solid ferric chloride. The optimum formulation for this data set is 0.3% ferrous chloride, 0.012% sodium hydroxide and 0.15% zinc oxide (30+1.2+15).

TABLE 9

Results from 3,785-Liter Emissions Trial Using 30% Ferrous Chloride Water Solution

| $FeCl_2$ + NaOH + | HCl Emmisions | | SOx Emissions | | Blow Time | | Penetration 25° C. | |
|---|---|---|---|---|---|---|---|---|
| ZnO ($10^{-2}$%) | kg/ton | % Red. | kg/ton | % Red. | hrs. | % Ben. | mm/10 | % Ben. |
| 30 + 0 + 30 | 0.045 | 58 | 0.088 | 76 | 2.71 | 88 | 17.7 | 53 |
| 30 + 1.2 + 15 | 0.047 | 56 | 0.085 | 77 | 2.77 | 86 | 18.6 | 67 |
| 15 + 0 + 15 | 0.053 | 51 | 0.140 | 62 | 2.91 | 83 | 17.0 | 42 |
| 30 + 2.4 + 0 | 0.053 | 51 | 0.086 | 77 | 2.07 | 102 | 19.8 | 87 |
| 15 + 1.2 + 0 | 0.055 | 49 | 0.109 | 70 | 3.78 | 63 | 16.5 | 35 |
| 15 + 0 + 0 | 0.078 | 28 | 0.142 | 61 | 2.25 | 98 | 17.6 | 51 |
| | | | Reference | | | | | |
| 0 + 0 + 0 | 0.014 | 88 | 0.368 | 0 | 6.51 | 0 | 14.4 | 0 |
| 30 ($FeCl_2$ solution) + 0 + 0 | 0.087 | 19 | 0.108 | 71 | 1.94 | 105 | 19.3 | 79 |
| 30 ($FeCl_3$ solid) + 0 + 0 | 0.107 | 0 | 0.159 | 57 | 2.17 | 100 | 20.6 | 100 |

EXAMPLE 4

3.785-Liter Converter Using Liquid Ferric Chloride and Chemical Modifiers

The testing was done with asphalt #2 air-blown in the 3,785-liter converter. Liquid ferric chloride was added to the asphalt as follows: Starting with 2,724 kilograms of asphalt in the converter, 2,270 kilograms was moved to the surge tank, leaving 454 kilograms in the converter. This allowed the asphalt level in the converter to be below the level of the port where the liquid ferric chloride was added. The blower was turned on and down to a differential pressure reading of 1.8. The liquid ferric chloride was then added slowly, using a hand rotary pump.

The chemical modifier was a combination of zinc oxide and sodium hydroxide. The zinc oxide and sodium hydroxide were added to the asphalt in the surge tank. The asphalt in the surge tank was then brought back to the converter and the run started.

Results and Discussion

Table 10 shows a summary of emissions, processing time and penetration data. It can be observed that none of the formulations reduced emissions to the extent attainable with solid ferric chloride. The optimum formulation for this example is 0.3% ferrous chloride+0.012% sodium hydroxide+0.15% zinc oxide (30+1.2+15).

TABLE 10

Results from 3,785-Liter Emissions Trial Using 40% Ferric Chloride Water Solution

| $FeCl_3$ + NaOH + | HCl Emmisions | | SOx Emissions | | Blow Time | | Penetration 25° C. | |
|---|---|---|---|---|---|---|---|---|
| ZnO ($10^{-2}$%) | kg/ton | % Red. | kg/ton | % Red. | hrs. | % Ben. | mm/10 | % Ben. |
| 30 + 1.2 + 15 | 0.120 | 35 | 0.107 | 61 | 2.57 | 79 | 18.4 | 74 |
| 30 + 2.4 + 15 | 0.123 | 33 | 0.106 | 61 | 2.35 | 85 | 18.0 | 66 |
| 30 + 3.6 + 0 | 0.096 | 48 | 0.124 | 54 | 1.99 | 96 | 18.2 | 68 |
| | | | Reference | | | | | |
| 0 + 0 + 0 | 0.085 | 54 | 0.272 | 0 | 5.31 | 0 | 15.0 | 0 |
| 30 + 0 + 0 | 0.185 | 0 | 0.145 | 47 | 1.84 | 100 | 19.6 | 100 |

EXAMPLE 5

Addition of Fabric Filter Between Knockout Tank and Incinerator

In an asphalt air-blowing process as described above, the fume line was equipped with a fabric filter after the knockout tank and before the incinerator. The fabric filter was turned on before the run was started and before the blower was turned on. The results are shown in Table 11:

TABLE 11

Addition of Fabric Filter

| Fabric | Other | HCl Emissions | | SOx Emissions | | Blow Time | Penetration 25° C. |
|---|---|---|---|---|---|---|---|
| Filter | Modif. | kg/ton | % Red. | kg/ton | % Red. | hrs. | mm/10 |
| No | — | 0.187 | 0 | 0.133 | 0 | 1.90 | 19.6 |
| Yes | — | 0.027 | 85 | 0.124 | 6 | 2.08 | 20.5 |
| Yes | — | 0.008 | 96 | 0.113 | 15 | 1.92 | 19.6 |
| Yes | Chem.* Modif. | 0.008 | 96 | 0.073 | 45 | 2.23 | 18.3 |
| Yes | Chem.** Modif. | 0.022 | 88 | 0.095 | 29 | 1.73 | 19.8 |

*A chemical modifier comprising 0.012% NaOH and 0.15% ZnO, by weight of the asphalt, was added to the asphalt in the converter.

**A chemical modifier comprising 1.82 kilograms of calcium hydroxide was added to the liquid seal in the knockout tank.

The results show significant reductions in HCl emissions by the use of the fabric filter alone and in combination with a chemical modifier.

EXAMPLE 6

Injection of Steam Into Fume Line After Converter

In an asphalt air-blowing process as described above, steam or water spray was injected into the fume line after the converter in an attempt to reduce hydrogen chloride emissions from the process. Both applications were attached to the fume line within 0.3 meter of exiting the converter. The results are shown in the following Table 12:

TABLE 12

| | | Injection of Steam | | | | | |
|---|---|---|---|---|---|---|---|
| | Other | HCl Emissions | | SOx Emissions | | Blow Time | Penetration 25° C. |
| Steam | Modif. | kg/ton | % Red. | kg/ton | % Red. | hrs. | mm/10 |
| No | — | 0.187 | 0 | 0.133 | 0 | 1.90 | 19.6 |
| Yes* | — | 0.021 | 89 | 0.131 | 2 | 2.10 | 19.0 |
| Yes** | — | 0.022 | 88 | 0.155 | −17 | 1.89 | 19.7 |
| Yes* | Fabric Filter | 0.008 | 96 | 0.113 | 15 | 1.92 | 19.6 |
| No | Water Spray* | 0.085 | 55 | 0.191 | −44 | 1.97 | 19.0 |

*3.785 kg. of condensed water per hour.
**9.5 kg. of condensed water per hour.

The results show a significant reduction in HCl emissions with steam or water spray. The steam was somewhat more effective, reducing HCl emissions by 88% and 89%. Using the steam in combination with a fabric filter produced an even greater HCl emissions reduction of 96%.

While the invention is described in terms of the benefit of reducing air pollution from hydrogen chloride emissions, it should be noted that the invention also provides other benefits. For example, the reduction of hydrogen chloride in the asphalt decreases the corrosiveness of the asphalt, so that there is less corrosion of the manufacturing equipment, and less corrosion of metal parts on the roof. The decreased corrosiveness of the asphalt allows it to be used in a wider variety of applications.

The principle and mode of operation of this invention have been described in its preferred embodiments. However, it should be noted that this invention may be practiced otherwise than as specifically illustrated and described without departing from its scope.

What is claimed is:

1. A method for reducing hydrogen chloride emissions from an asphalt blowing process comprising:

modifying an asphalt by adding a catalyst selected from ferric chloride, ferrous chloride, or mixtures thereof, and by adding a chemical modifier, and subjecting the modified asphalt to a blowing process which produces a fume stream containing hydrogen chloride, and emitting the fume stream, wherein the addition of the chemical modifier reduces the hydrogen chloride emissions from the blowing process by at least about 25% by weight compared to the same blowing process without the addition of the chemical modifier.

2. The method of claim 1 wherein the chemical modifier is selected from sodium hydroxide, zinc oxide, ferric stearate, iron oxide, ferric citrate, high molecular weight amines, polyamines, aluminum, a combination of sodium hydroxide and zinc oxide, a combination of sodium hydroxide and ferrous oxide, a combination of aluminum and ferrous oxide, or a combination of aluminum and zinc oxide.

3. The method of claim 2 wherein the chemical modifier comprises a combination of sodium hydroxide and zinc oxide.

4. The method of claim 1 wherein the chemical modifier includes sodium hydroxide which is added at a level of not greater than about 0.012% by weight of the asphalt, per every 0.1% by weight of active catalyst added to the asphalt.

5. The method of claim 1 wherein the chemical modifier includes zinc oxide which is added at a level of not greater than about 0.15% by weight of the asphalt, per every 0.1% by weight of active catalyst added to the asphalt.

6. The method of claim 1 comprising the additional step, after the blowing process, of passing the fume stream through a filter which further reduces the hydrogen chloride emissions from the blowing process by at least about 10% by weight.

7. The method of claim 1 comprising the additional step, after the blowing process, of passing steam through the fume stream to further reduce the hydrogen chloride emissions from the blowing process by at least about 10% by weight.

8. A method for reducing hydrogen chloride emissions from an asphalt blowing process comprising:

modifying an asphalt by adding a catalyst selected from ferric chloride, ferrous chloride, or mixtures thereof, and by adding a chemical modifier comprising a combination of sodium hydroxide and zinc oxide, the sodium hydroxide being added at a level of not greater than about 0.012% by weight of the asphalt, and the zinc oxide being added at a level of not greater than about 0.15% by weight of the asphalt, per every 0.1% by weight of active catalyst added to the asphalt, subjecting the modified asphalt to a blowing process which produces a fume stream containing hydrogen chloride, and emitting the fume stream, wherein the addition of the chemical modifier reduces the hydrogen chloride emissions from the blowing process by at least about 25% by weight compared to the same blowing process without the addition of the chemical modifier.

9. The method of claim 8 wherein the sodium hydroxide is added at a level of at least about 0.001% by weight of the asphalt, per every 0.1% by weight of active catalyst added.

10. The method of claim 8 wherein the zinc oxide is added at a level of at least about 0.002% by weight of the asphalt, per every 0.1% by weight of active catalyst added.

11. The method of claim 8 wherein the addition of the chemical modifier reduces the hydrogen chloride emissions by at least about 45% by weight.

12. A method for reducing hydrogen chloride emissions from an asphalt blowing process comprising:

modifying an asphalt by adding a catalyst selected from ferric chloride, ferrous chloride, or mixtures thereof, and by adding a chemical modifier, and subjecting the modified asphalt to a blowing process which produces a fume stream containing hydrogen chloride, and emitting the fume stream, wherein the addition of the catalyst provides a beneficial effect of an increased final penetration compared to the same blowing process without the addition of the catalyst, wherein the addition of the chemical modifier reduces the hydrogen chloride emissions from the blowing process by at least about 25% by weight, compared to the same blowing process without the addition of the chemical modifier, and wherein the addition of the chemical modifier does not reduce the beneficial effect of the catalyst by greater than about 50%.

13. The method of claim 12 wherein the addition of the chemical modifier does not reduce the beneficial effect of the catalyst by greater than about 35%.

14. The method of claim 12 wherein the addition of the catalyst additionally provides a beneficial effect of an increased blowing rate compared to the same blowing process without the addition of the catalyst, and wherein the addition of the chemical modifier does not reduce the beneficial effect of the catalyst by greater than about 50%.

15. The method of claim 12 wherein the chemical modifier includes sodium hydroxide which is added at a level of not greater than about 0.012% by weight of the asphalt, per every 0.1% by weight of catalyst added to the asphalt.

16. The method of claim 12 wherein the chemical modifier includes zinc oxide which is added at a level of not greater than about 0.15% by weight of the asphalt, per every 0.1% by weight of catalyst added to the asphalt.

17. The method of claim 12 wherein the addition of the catalyst provides a beneficial effect of increasing the final penetration by at least about 15% compared to the same blowing process without the addition of the catalyst, and wherein the addition of the chemical modifier does not reduce the beneficial effect of the catalyst by greater than about 35%.

18. The method of claim 12 wherein the chemical modifier is selected from sodium hydroxide, zinc oxide, ferric stearate, iron oxide, ferric citrate, high molecular weight amines, polyamines, aluminum, a combination of sodium hydroxide and zinc oxide, a combination of sodium hydroxide and ferrous oxide, a combination of aluminum and ferrous oxide, or a combination of aluminum and zinc oxide.

19. The method of claim 12 comprising the additional step, after the blowing process, of passing the fumes stream through a filter which further reduces the hydrogen chloride emissions from the blowing process by at least about 10% by weight.

20. The method of claim 12 comprising the additional step, after the blowing process, of passing steam through the fume stream to further reduce the hydrogen chloride emissions from the blowing process by at least about 10% by weight.

* * * * *